United States Patent [19]

Fritz et al.

[11] 4,300,436

[45] Nov. 17, 1981

[54] BLIND CAPTURE SYSTEM

[75] Inventors: Gary R. Fritz, Ferdinand; John W. Robinson, Jasper, both of Ind.

[73] Assignee: Kimball International, Inc., Jasper, Ind.

[21] Appl. No.: 121,406

[22] Filed: Feb. 14, 1980

[51] Int. Cl.[3] ..... G10B 3/10

[52] U.S. Cl. ..... 84/345; 84/370

[58] Field of Search ..... 84/1.01, 1.03, 345, 84/370

[56] References Cited

U.S. PATENT DOCUMENTS

| | | | |
|---|---|---|---|
| 3,590,132 | 6/1971 | Robinson et al. . | |
| 3,659,488 | 5/1972 | Deutsch . | |
| 3,699,839 | 10/1972 | Denigan et al. | 84/345 |
| 3,700,784 | 10/1972 | Molnar . | |
| 3,926,087 | 12/1975 | Griffis | 84/345 |
| 3,935,781 | 2/1976 | Katoh et al. . | |
| 3,992,969 | 11/1976 | Robinson et al. . | |
| 4,006,658 | 2/1977 | Kappes et al. | 84/345 |
| 4,092,895 | 6/1978 | Zabel | 84/345 |
| 4,157,049 | 6/1979 | Watanabe | 84/1.01 X |
| 4,173,167 | 11/1979 | Stanley | 84/345 |

*Primary Examiner*—S. J. Witkowski

*Attorney, Agent, or Firm*—Albert L. Jeffers; John F. Hoffman

[57] ABSTRACT

A blind capture system for organs and other electronically actuated musical instruments enabling the setting of control switches, such as voicing tabs or keys of the keyboard, to be stored for reactivation upon command. The system includes a programmable, random access memory capable of storing data representative of the composite states of the switches and includes a plurality of storage frames in which data corresponding to a plurality of separate combinations of actuated switches can be stored. The switches are scanned by a multiplexer to produce a time division multiplexed serial data stream, which is then loaded into the memory during the store mode in such a manner that the data will be entered into the proper storage frame. The data is read out of the memory as a serial data stream, which is demultiplexed to produce a parallel format signal which is connected to the control inputs for the system controlled by the switches over a bidirectional data bus. This same bus is utilized for entering data from the switches when the instrument is in the store mode. When the blind capture system is in use, the switches are electrically isolated from the inputs of the system controlled thereby, such as the organ voicing system, and all control is maintained from the blind capture system over the bidirectional data bus.

30 Claims, 15 Drawing Figures

SOLO KEYBOARD
ACCOMP KEYBOARD
PEDALBOARD
TONE GENERATOR
KEYERS
16
VOICING
AUDIO SWITCHING SECTION
AUDIO INPUTS
AUDIO OUT
TAB
CONTROLS
AUDIO AMP
TO AUDIO AMP
8' FLUTE
16' FLUTE
TAB SWITCHES
BIDIRECTIONAL TAB BUS
ELECTRONIC SWITCH OUT
IN
CONTROL
BLIND CAPTURE SYSTEM
INPUTS/OUTPUTS
-V
CANCEL
STORE
8 PRESET BUTTONS

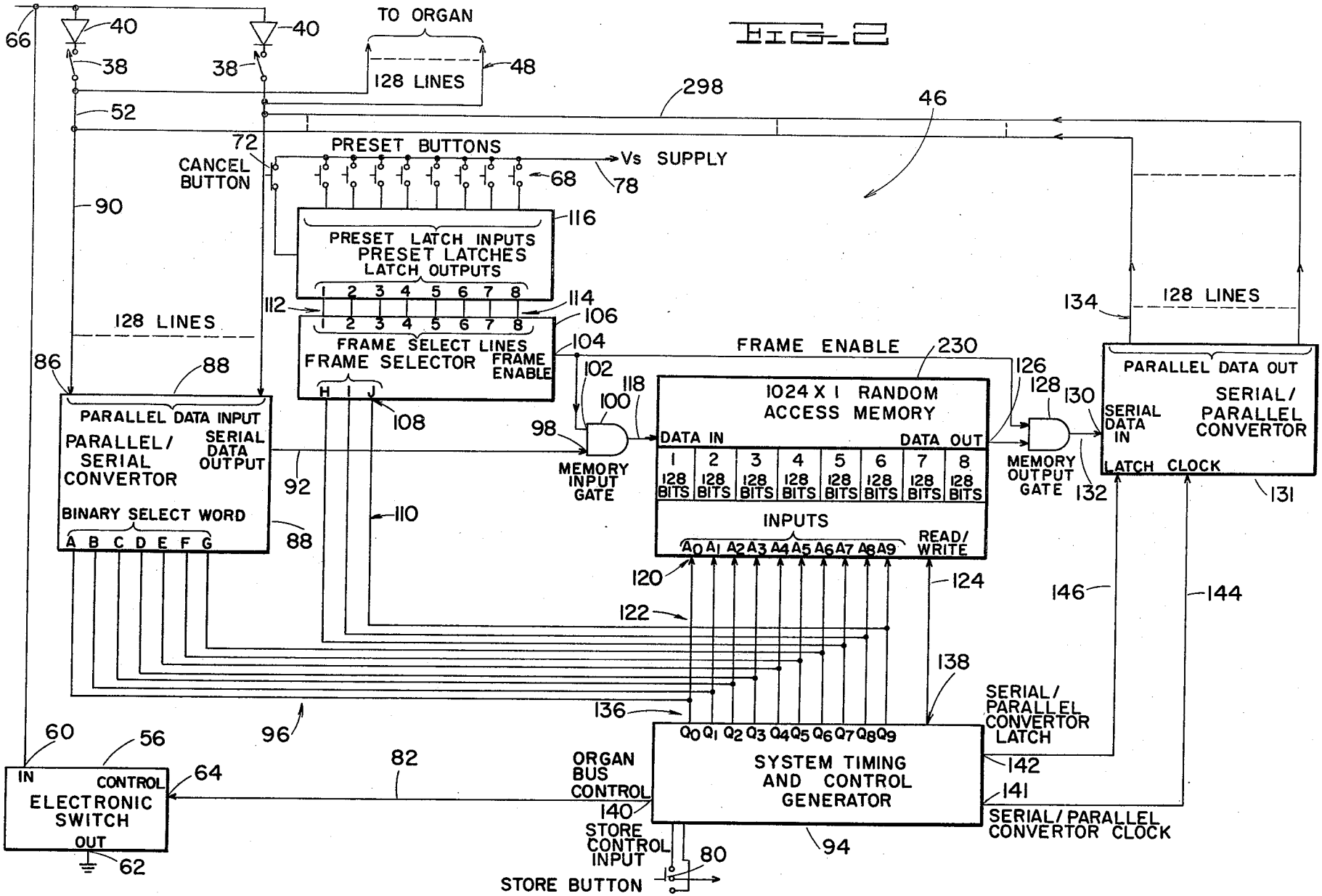
FIG. 2
PARALLEL DATA OUT
SERIAL/ PARALLEL CONVERTOR
SERIAL DATA IN
LATCH CLOCK
128 LINES
MEMORY OUTPUT GATE
SERIAL/ PARALLEL CONVERTOR LATCH
SERIAL/ PARALLEL CONVERTOR CLOCK
1024 X 1 RANDOM ACCESS MEMORY
FRAME ENABLE
DATA OUT
DATA IN
128 BITS
INPUTS
READ/ WRITE
SYSTEM TIMING AND CONTROL GENERATOR
MEMORY INPUT GATE
ORGAN BUS CONTROL
STORE CONTROL INPUT
STORE BUTTON
Vs SUPPLY
PRESET BUTTONS
PRESET LATCH INPUTS
PRESET LATCHES
LATCH OUTPUTS
FRAME SELECT LINES
FRAME SELECTOR
TO ORGAN
CANCEL BUTTON
PARALLEL DATA INPUT
SERIAL DATA OUTPUT
PARALLEL/ SERIAL CONVERTOR
BINARY SELECT WORD
CONTROL
ELECTRONIC SWITCH
IN
OUT E. F. G.
176
TO SERIAL/ PARALLEL CONVERTOR
H.
144
148
150
156
160
162
164
170
IM HZ CLOCK
CK
152
FOUR PHASE CLOCK GENERATOR
Q1
Q2
Q3
Q4
φ1
φ2
φ3
φ4
158
154
SERIAL/ PARALLEL CONVERTOR CK
COUNTER CLOCK INHIBIT=1
165
CK
COUNTER
168
Q0
Q1
Q2
Q3
Q4
Q5
Q6
Q7
Q8
Q9
Q10
Q11
I.
J.
K.
L.
M.
N.
O.
P.
Q.
R.
S.
128 DECODE
TIMING GENERATOR BLOCK
94
COUNTER CLOCK INHIBIT
318
166
Q0 Q1 Q2 Q3
SHIFT REGISTER
CKA RA CKB RB
180
181
INITIALIZE
178
184
182
174
φ3
172
CT 128=1

INPUT CLAMP
16 TO 1 DATA SELECTOR
DATA
A B C D
90
212a
212b
212c
212d
212e
212f
212g
212h
210a
210b
210c
210d
210e
210f
210g
210h
218a
218b
218c
218d
218e
218g
218h
PARALLEL / SERIAL CONVERTER BLOCK
88
220
222
228
0 1 2 3 4 5 6 7
Q0 Q1 Q2 Q3
Q4 Q5 Q6
214 215 216 217
224 225 226
L' M' N' O' P' Q' R' S'
SERIAL DATA 344a
350a
LATCH
PRESET 1
344b
350b
LATCH
PRESET 2
344c
PRESET 3
LATCH
350c
344d
PRESET4
LATCH
350d
PRESET A ENABLES
352a
352b
352c
352d
353a
353b
353c
353d
PRESET B ENABLES
382
384
390
396
380
386
388
392
394
STORE
176
STORE CYCLE
180
178
184
COMMAND
182
354
Q0 Q1 Q2 Q3 Q0 Q1 Q2 Q3
DUAL 1 of 4
A1 B1 E1 A2 B2 E2
358
346
360
LATCH
A PRESET
362
356
LATCH
368
348
366
B PRESET
363
370
365
364
COUNTER
CK
Q0
Q1
Q2
Q3
Q4
Q5
Q6
Q7
Q8
Q9
Q10
Q11
362
φ1
372

BLIND CAPTURE SYSTEM

BACKGROUND OF THE INVENTION

The present invention relates to a capture system for electronically actuated keyboard musical instruments, such as electronic and pipe organs, electronic pianos, and the like, wherein a plurality of different combinations of control switch settings can be programmed into the organ for recall and activation at a later time.

Capture systems for organs and other keyboard musical instruments are well known in the art and have been used extensively to enable a performer to recall and automatically implement a combination of tab switches previously set into the organ. Early organ tab preset systems were entirely mechanical in nature and typically comprised various mechanical interconnections between the tab switches and the voicing control system of the organ. Not only were these systems complicated, expensive and difficult to maintain, but they occupied a substantial amount of space in the organ console.

One of the first advances which was realized in the art of organ tab preset systems came about with the introduction of electromechanical devices, which enabled the bulk of the preset system to be reduced somewhat and improved reliability of operation. There were still numerous problems with such systems, however, due to the cost of the electomechanical devices and their susceptibility to mechanical failure. Furthermore, their response time was quite slow in comparison to present day electronic devices, and the noise produced by the relays was objectionable. The next advancement came with the introduction of photoelectric devices which, although a substantial improvement over the bulky, mechanical relays and solenoids, were costly and required a light source. Additionally, the photoelectric devices were relatively slow in operation and their operating characteristics tended to vary with time.

With the development of modern electronic switches, such as field effect transistors and the like, it became possible to switch on and off the various voices of the organ by means of low voltage DC control signals. Since the electronic switches are activated by DC voltages, a minimum of interface circuitry is required between the memory and the electronic switch. On the early organ tab preset systems which utilized these solid state memory devices, many such devices were required because one terminal of each device was required to convey tab information to and from the memory. Since many organs have a very large number of tabs, a correspondingly large number of terminals from the memory of memories were required. This resulted in greatly increased costs and complexity of the system and increased maintenance problems.

More recently, the well known technique of multiplexing has been applied to organ tab preset systems. This type of system requires some sort of memory to which the tab information is stored and retrieved, and several systems have employed a form of shift register memory. A problem with this type of system, is that the number of shift registers required is quite large in order to handle the large number of preset combinations. Other prior art systems, such as that disclosed in U.S. Pat. No. 3,699,839, require a plurality of memories with complex input and output circuitry necessary to store the tab settings and then retrieve them at a later time for implementation.

SUMMARY OF THE INVENTION

The blind capture system according to the present invention overcomes the problems and disadvantages of prior art systems in that the amount of memory which is required has been reduced to a minimum amount and the input and output circuitry associated with the memory has been greatly simplified. Furthermore, the system is quite flexible in that preset selections can be self-cancelling, if desired, when another preset is selected, or can be cumulatively implemented so that the voicing builds as successive presets are selected. Furthermore, additional tab switch settings may be added to a previously stored combination without erasing the previously stored combination from the memory.

The system according to the disclosed embodiment of the invention has the capability of storing eight tab combinations, with each tab combination consisting of up to one hundred and twenty-eight tabs, into a single electronic memory chip. Expansion of the memory capabilities of the system is easily accomplished using similar electronic memory chips, which are commercially available today. The system also has the capability of being either user programmable or factory programmed by simply changing the electronic memory device from a random access memory to a read only memory. If desired, the system could include both memories with the capability of switching from one type of memory to the other. Be selecting the read only memory, the organist could effectively have the tab combinations of the entire concert permanently stored in the memory chip, and all that would be necessary would be to plug in the chip prior to the performance. Obviously, a plurality of such chips could be provided, wherein each chip would store the proper sequence of tab combinations for a given musical composition.

The organ tab switches are isolated from the organ voicing system control inputs when the blind capture system is in use so that the voicing is selected by control signals from the blind capture system. During the store mode, however, the tab switches are momentarily enabled and scanned by a multiplexer which produces a time division multiplexed serial data stream which is loaded into the proper storage frame of the random access memory, and the tab switches are then again isolated from the system. The stored data is read out of the selected storage frame of the memory as a serial data stream, which is then demultiplexed and a parallel format signal comprising the one hundred and twenty-eight tab settings is connected to the respective inputs of the organ voicing system. If a new tab switch combination is written into a storage frame of the memory in which a previous tab setting is stored, the previous setting will be erased and supplanted by the new setting. In accordance with a modification, however, newly actuated tab switches can be stored into the memory in a storage frame wherein a previous tab setting is already stored without erasing the previously stored setting. This enables additional voices to be added to a previously stored preset.

The storage frames into which data is stored and from which data is read are selected by means of eight momentary actuation preset buttons under the control of the performer. Alternatively, four preset buttons together with two group preset buttons can be employed to select a possible eight different presets by selecting various combinations of the six buttons.

In order to store a preset, the blind capture system is activated and the desired combination of up to one hundred and twenty-eight tab switches is selected by the performer. One of the preset buttons is then actuated so as to select the desired location within the memory for the preset, and storage of the preset is accomplished by depressing the store button. A new preset may then be set by actuating selected tab switches, and this stored in another storage frame of the memory by first depressing one of the other preset buttons and then depressing the store button. By following this procedure, up to eight different presets, each of which has the capability of storing combinations for one hundred and twenty-eight different tab switches, can be stored.

To select and play a stored preset, all that is necessary is to depress one of the preset buttons thereby recalling that preset from the memory and activating the corresponding electronic switches within the organ voicing system.

The system according to the present invention affords the organist the flexibility of selecting many different tab combinations prior to playing the organ. Then, during the performance, the organist can instantly recall and implement any one of the preselected tab combinations by simply pressing a single button. This is of considerable advantage, since the manual activation of the desired tabs during a performance requires a substantial amount of time. Furthermore, the tab settings can be changed during the performance of a musical composition simply by pressing a single button, thereby eliminating the necessity for resetting the tab switches during the performance of the composition, a technique which requires considerable skill.

Not only can the capture system be utilized to store and recall various tab switch settings, but could also be used to store and recall the actuation of combinations of keys of the keyboard. Thus, complex chord formations can be instantly recalled and played merely by pressing a single button.

One aspect of the present invention is a blind capture system for use in a keyboard musical instrument having a system for controlling the tones produced by the instrument under the control of a plurality of player operated switches. The capture system comprises a programmable memory capable of storing data representative of the composite states of the switches, a bidirectional data bus having lines connected respectively to the outputs carrying electrical signals corresponding to electrical states of respective switches, memory input circuitry interposed between the data bus and the memory for writing into a section of the memory, when the memory is in the write mode, preset data representative of the states of the switches wherein the preset data corresponds to electrical signals present on the data bus, memory output circuitry interposed between the memory and the data bus for reading out of the memory, when the memory is in the read mode, the preset data and placing in the data bus electrical signals corresponding to the preset data read out, and means for isolating the switches from their respective outputs when the memory is in the read mode.

According to another aspect of the present invention, the blind capture system comprises a programmable memory capable of storing data representative of the composite states of the switches wherein the memory comprises a plurality of storage frames in which data corresponding to a plurality of separate combinations of actuated switches can be stored, memory input circuitry interposed beteen the switches and the memory for scanning the switches and inputting data into the memory in the form of a time division multiplexed serial data stream corresponding to the actuated switches, and memory output circuitry interposed between the memory and the inputs of the tone controlling circuitry for reading out data stored in the memory in a time division multiplexed serial data format, demultiplexing the data, and placing on the inputs of the tone control circuitry electrical signals corresponding to the data which is read out. Player operated preset select circuitry controls the memory input and output circuitry to store and read out data from a selected frame of the memory, and selectively actuated store circuitry associated with the memory input circuitry operatively connects the player operated switches to the memory input circuitry to enable the switches to be scanned and data inputted to the memory only during the time interval that the storage frame selected by the preset select circuitry is being addressed to thereby store data corresponding to the actuated player operated switches in the selected storage frame. A selectively activated memory addition circuit, which is synchronized with the addressing of the memory, stores data in a selected frame of the memory corresponding to additional player operated switches which are actuated without erasing data presently in the selected frame.

According to another aspect of the invention, a read only memory is provided in which is stored data corresponding to a plurality of separate combinations of actuated player operated switches. The read only memory is addressed and data read out of it and placed on the inputs of the tone control circuitry in the form of electrical signals corresponding to a selected combination of actuated switches. Player operated switch means is provided for disabling data from the programmable memory and for selectively disabling data from the read only memory.

According to yet another aspect of the invention, a blind capture system is provided which comprises a memory in which is stored data representative of a plurality of different combinations of actuated switches wherein the data representative of the plurality of different combinations is stored in a plurality of respective storage frames. Player operated preset select means selects storage frames of the memory and comprises a manually actuated element capable of movement from one position to a second position so as to commulatively and successively select the storage frames one at a time as the element is moved continuously from one position to the other. Memory output circuitry connected to the memory addresses the selected storage frames of the memory and reads out the data stored therein so as to produce a plurality of electrical control signals on corresponding ones of the control inputs, which signals cause the tone control circuitry to be activated in a manner consistent wth the combination of control inputs on which the electrical control signals are present. If desired, the manually actuated element may take the form of a foot operated pedal, similar to the expression pedal of a conventional electronic organ.

The subject matter of the present invention is particularly pointed out and distinctly claimed in the concluding portion of the specification. The invention itself, however, together with the objects and advantages thereof, may best be understood by reference to the following description taken in conjunction with the accompanying drawings.

BRIEF DESCRIPTION OF THE DRAWINGS

FIG. 2 is a block diagram of the blind capture system itself;

DETAILED DESCRIPTION

Figures 1, 1A:
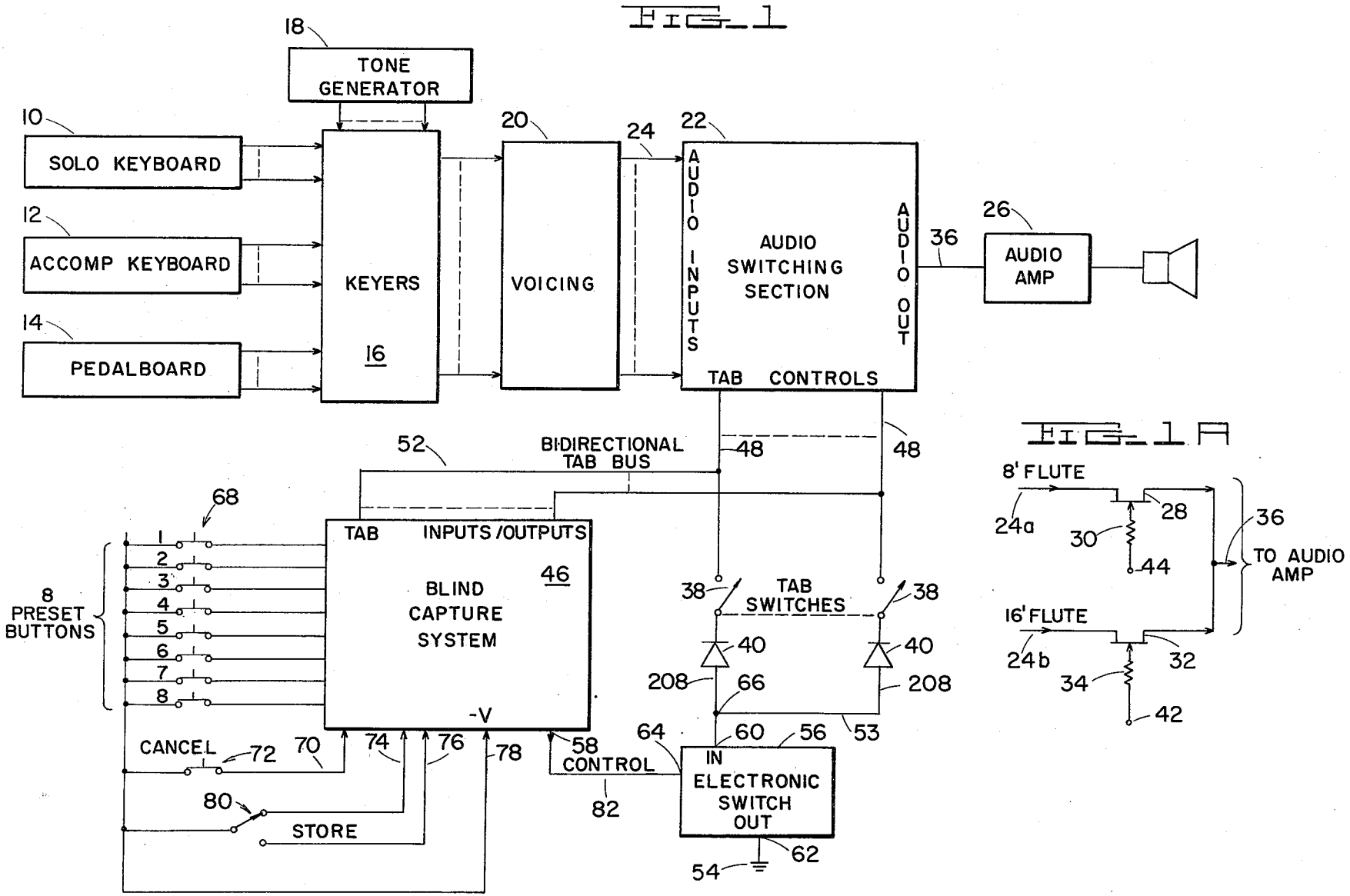
FIG. 1 is an overall block diagram of an electronic organ including a blind capture system according to the present invention.
FIG. 1A is a schematic of a portion of the audio switching section.

With reference to FIG. 1, an overall block diagram of an electronic organ incorporating the blind capture system of the present invention is illustrated. By blind capture is meant a system where the presets may be activated without physically setting the tabs. The solo keyboard 10, accompaniment keyboard 12 and pedalboard 14 are shown directly connected to the keyer bank 16. It should be noted that this arrangement is the simplest possible arrangement for an electronic organ, that is, wherein the key switches for the individual keys on the keyboards 10, 12 and 14 are connected directly to the keyers so as to key tones from tone generator 18 to the voicing system 20. In many present electronic organs, on the other hand, very complex circuitry is normally interposed between the keyboards and keyers for the purpose of incorporating easy play features, multiplexing, and other special effects not related to the present invention.

The keyed tones are then fed to the voicing system 20 wherein the various voices, such as voilins, flutes, diapason, etc., are generated by conventional circuitry, and the audio outputs are fed into the audio switching section 22 over lines 24. It is within the audio switching section that a plurality of field effect transistors (FIG. 1A) switch the various outputs 24 of the voicing system into the audio amplifier 26. Two such field effect transistors are shown in FIG. 1A wherein line **24*a* carries the eight foot flute signal and line 24*b* the sixteen foot flute sinal. Field effects transistors 28 and 32 are connected to lines 24*a* and 24*b*, respectively, and have gate terminals 30 and 34, respectively. When an enabling signal is present on gates 30 and 34, transistors 28 and 32, respectively, will be turned on thereby acting as closed mechanical switches so that the respective signals are connected to line 36**.

The tab switches 38, which may number as many as one hundred and twenty-eight in the present embodiment, are connected to ground potential through diodes 40 in their enabled condition, and when closed, place ground potential on the terminals 42 and 44 (FIG. 1A) thereby causing their respective field effect transistors 28 and 32 to be activated and function as a closed circuit. With field effect transistors 28 and 32 activated, when a note on the appropriate manual is played, it will have the sound of an eight foot flute and a sixteen foot flute played together.

The blind capture system 46 is connected directly to the tab control inputs 48, which are connected to the respective connection is made by way of a bidirectional tab bus 52, which comprises one hundred and twenty-eight wires connected on a one to one basis with tab control inputs 48. The bidirectional bus 52 is utilized both as an input and as an output of the blind capture system 46. The common side of the tab switches 38 are connected to ground potential 54 through common bus 53 and an electronic switch 56, which is controlled by the organ tab bus control output 58 from the blind capture system 46. Electronic switch 56 may be simply a field effect transistor or other type of electronic switch having an input 60, an output 62 and a control terminal 64. The organ tab bus control signal at control terminal 64 alternatively causes the common side of the tab switches connected together at the juncture 66 to be switched to ground or to remain open thereby permitting the common side of the tab switches to float. When the blind capture system 46 is disabled by activating cancel switch 72 electronic switch 56 is turned on by the control signal 64, which is the organ tab buss control output 58 from the blind capture system, and the common side of the tab switches 38 is connected to ground potential 54. In this case, the tab switches 38 function as they normally would in the organ, switching on and off the various voices of the organ in combinations selected manually by the person playing the organ.

Eight preset buttons 68 are connected to the blind capture system thereby permitting eight separate combinations to be stored and selected at will. Also connected to the blind capture system 46 as inputs are line 70, which is connected to the negative voltage supply through switch 72, and lines 74 and 76, which are connected to the negative voltage on line 78 through two pole switch 80. Switch 80 functions to store a selected tab preset, and switch 72 functions to cancel a selected preset or group of selected presets.

In order to store a preset tab combination into the blind capture system or retrieve a preset tab combination for voicing of the organ, one of the preset buttons 68 is actuated. The blind capture system then automatically transmits a disabling signal from output 58 to the control input 64 of electronic switch 56 thereby causing it to open and permit tab switches 38 to float. At this point, the tab switches no longer have an effect on the system, and even if they would be closed, the audio switching section 22 will perceive no effect. This is because of the isolation diodes 40 which are in series with the common sides of each tab switch 38 which prevent closed switches from being shorted together at junction 66. The bi-directional tab bus 52 now functions as tab outputs with the combination of signals on the one hundred and twenty-eight lines of bus 52 being connected to the corresponding lines 48 so as to switch the appropriate voices within audio switching section 22.

If no tab combination were stored in the location of the memory corresponding to the selected preset button 68, or if it is desired to store a new tab combination, the tab switches 38 must first be arranged in the proper configuration to achieve the desired voicing of the signals. When the tab switches 38 are arranged as desired, and the appropriate preset button or switch 68 has been actuated, actuation of the store switch 80 will cause electronic switch 56 to close thereby permitting the tab switches 38 to be connected to ground and become operative for the duration of time required for the tab configuration to be stored into the blind capture system 46 via the bidirectional tab bus 52, which now acts as the input to the blind capture system 46. At the end of the store cycle, which is very short in duration, the electronic switch is automatically deactivated thereby causing the tab switches 38 to again float. Now, the bidirectional tab bus 52 acts as an output so that the tab switch combination thereon, which is connected to the appropriate tab control inputs 48, activates the appropriate voicing within audio switching section 22. Further closure of tab switches 38 from this point on will have no effect whatsoever on the presets which are stored or played unless the store switch 80 is again actuated. It is intended that switches 68, 72 and 80 all be of the momentary contact type so that they will return to their unactuated conditions when released by the player.

In order to disable the selected preset, all that is necessary is to actuate another preset switch 68 or the cancel switch 72. Either of these two procedures will cause the previously selected preset to be cancelled. This procedure of activating a preset, setting up the tab configurations as desired, and actuating the store switch can continue unitl a maximum of eitht preset tab combinations have been stored in the blind capture system 46. The preset tab combinations can be selected by simply pressing the desired preset button or buttons 68, and all eight of the present tab combinations can be selected at once by pressing all eight preset buttons 68.

Thus, the various voices of the organ can be selected by either manually setting up the tab switches 38 to the desired configuration, or by actuating any or all of the presets of the blind capture system 46 which would configure the one hundred and twenty-eight tab outputs of the bidirectional tab bus 52 to the tab configuration which had been previously stored into the system.

With reference now to FIG. 2, the blind capture system 48 is shown in block diagram form. As discussed above, the present embodiment has the capability of accommodating one hundred and twenty-eight organ tab switches 38, and the tab configurations selected by the player, which may number up to eight different configurations, are stored in a 1,024 by 1 random access memory 230 organized as 128 by 8.

The one hundred and twenty-eight tab switches 38 are applied to one hundred and twenty-eight inputs 86 of parallel to serial convertor 88 by lines 90, which are connected to data bus 52. Parallel to serial convertor 88 converts the one hundred and twenty-eight bit wide data word, which represents the organ tab configuration, into one hundred and twenty-eight bits of consecutive serial data on output line 92. Convertor 88 is under the control of the binary select word ABCDEFG, which is generated in the system timing and control generator block 94 and connected to parallel to serial convertor 88 over lines 96. Binary select word ABCDEFG is capable of one hundred and twenty-eight different states, and consecutively enables the organ tab data inputs.

The tab data, which appears in serial form on line 92, is supplied to input 98 of input memory gate 100. The other input 102 is connected to the frame enable output 104 of frame selector block 106. The frame enable signal on input 102 of gate 100 determines which frame or frames of one hundred and twenty-eight bits the memory 230 will operate in. Applied to the inputs 108 of frame selector block 104 is the binary select word HIJ, which is generated by the system timing and control generator block 94 and connected to frame selector block 106 over lines 110. The binary select word HIJ on inputs 108 indicates which frame of memory the system is presently capable of being operated in.

Applied to inputs 112 of frame selector block 106 are the eight frame select lines 114. Activation of any of the frame select lines 114 causes a frame enable signal on output 104 to be generated in the selected frame or frames so as to determine which frame of memory the system will operate in. The frame select lines 114 are driven by eight latch outputs of the preset latch block 116, which provides the means for latching a signal when one of the preset buttons 68 has been actuated. The actuation of a preset button 68 will cause the corresponding latch output connected to lines 114 to activate, and deactivation of one of the latch outputs is accomplished by either selecting another preset by actuating another one of preset switches 68, or by actuating the cancel switch 72. When another preset switch 68 is actuated, the previously selected preset and corresponding preset latch output connected to one of lines 114 is disabled.

Accordingly, the output on line 118 of memory input gate 100 is serial tab data from parallel to serial convertor 88 which has been enabled in the proper one hundred twenty-eight bit frame or frames which is selected by means of the preset switches 68. The output of the memory input gate 100 is applied to the data input gate of random access memory 230 so that the data thereon can be stored in the selected frame of memory. Inputs 120 carry the address inputs A0 through A9, and the state of these address inputs 120 determines which of the 1,024 bits of memory is presently available for storage or readout. The address inputs 120 are supplied from the system timing and control generator block 94 over lines 122. The read/write input to memory 230 is supplied by system timing and control generator block 94 over line 124. This input determines whether the memory is operating in the read mode wherein data in the location selected by the address inputs is transmitted out of the data output terminal 126 to memory output gate 128, or whether the memory is in the write mode wherein the data present at the data input on line 118 is written into the memory location selected by the state of the address inputs 120. Normally, the memory 230 is in the read mode, and is in the write mode only momentarily after the store switch 80 is actuated for the duration of time necessary for the tab information to be stored into the memory. After storage of the tab data on line 118 is complete, the memory 230 is returned to the read mode.

The output of memory output gate 128 is tab data in serial form of the frame or frames of memory 230 which are selected. This serial tab data is applied to the serial data input 130 of serial to parallel convertor 131 over line 132. At the end of every memory unload cycle, the serial tab data which has been loaded into the serial to parallel convertor 131 is converted back into parallel form by being latched into the parallel data outputs 134. These one hundred and twenty-eight parallel data outputs 134 are electrically connected to the one hundred and twenty-eight organ tab control inputs 48 over bidirectional data bus 52. Accordingly, the tab configuration or configurations which are read out of the frame or frames of memory activate those field effect transistors, such as transistors 28 and 32 of FIG. 1A, within audio switching section 22 that correspond to the selected tabs which were stored in the memory. It will be recalled that electronic switch 56 isolates tab switches 38 from tab control inputs 48 so that the only voicing control which is available is that determined by the outputs 134 of serial to parallel convertor 131 when a preset or presets have been selected.

The system timing and control generator block 94 generates the timing and control signals required by the system. The ten outputs 136 Q0-Q9 instruct the system as to which bit location or frame of the memory is presently being addressed. The memory mode control output 138 carries the read/write control signal, and the organ bus control output 140, which is connected to line 82, controls the electronic switch 56 to enable or disable the common side of the organ tab switches 38 by connecting them to or disconnecting them from ground potential.

The serial to parallel convertor clock output 141 places on line 144 a clock pulse train which controls the operation of serials to parallel convertor 131 to load and shift serial data from input 130. The serial to parallel convertor latch output 142 places on line 146 a latch signal which transfers the serial data from the serial bit locations within convertor 131 to parallel data outputs on lines 134.

The detailed schematic for the blind capture system is contained within FIGS. 3A–3E. The first portion to be discussed is the timing generator block shown primarily in FIG. 3B, which is the block that generates the timing signals necessary for operation and synchronization of the system. Clock 148, which is an astable multivibrator, runs at one megahertz, and its output 150 is connected to the clocking input 152 of four phase clock generator 154. Clock generator 154 is a 14015 dual four bit shift register configured to generate a four phase timing clock output 156 and a serial to parallel convertor clock output 158. The phase 1 output on line 160 is connected to one of the inputs of OR gate 162, and at every one hundred and twenty-eight phase 1 pulse, a counter clock inhibit signal is applied to the second input 164 of OR gate 162 over line 165 from shift register 166. This inhibits the phase 1 signal on line 160 from passing through OR gate 162 for four phase 1 pulses. The counter clock inhibit signal is generated by shift register 166, which is a 14015 dual four bit shift register, and generates the counter clock inhibit signal by detecting count 128 at the output of counter 168.

Counter 168, which is a type 4040 counter, is clocked by the phase 1 clock signal on clock input 170 and produces on outputs Q0-Q6 a binary word having one hundred and twenty-eight different states. The 128 decode signal on line 172 is connected through AND gate 174, the other input of which is the inverted phase 3 clock signal from inverter 176, through inverter 178 to the A and B clock inputs 180 and 181. The least significant bit output Q0 of counter 168 is gated through AND gate 182 and inverter 184 to the A and B resets of shift register 166. Counter 168 is a twelve stage binary counter the outputs Q0 through Q10 of which are used as binary address words for the rest of the system. Line 144, which is connected to the Q1 output 158 of clock 154 carries the clock train for the serial to parallel convertor 131.

With references to FIG. 3A, the preset input latch block 116 will be described. Preset input latches **150*a* through 150*h*, which are made up of NAND gates are activated by closing their respective preset switches 68A through 68H. Cancel switch 78 is connected through diode 152 to line 153, and this line is connected to the reset terminals of each of the latches 150*a* through 150*h*. When the cancel button 78 is closed, each of the latches 150*a*–150*h* will be deactivated so that the signals present on their output lines 154*a*–154*h* will correspond to switch open conditions. The initialized signal through diode 155, which occurs when the circuit is started up, will similarly cancel all preset signals by resetting latches 150*a*–150*h***.

When the optional automatic cancel circuit 156, which is shown in a dashed hyphen line box, is included, automatic deactivation of previously activated preset latches **150*a*–150*h* occurs whenever a new preset switch 68*a*–68*h* is actuated. This is accomplished by connecting line 160 to each of the outputs of switches 68*a*–68*h*, with the output line 162 of the circuit comprising diode 163, resistors 164 and 165, capacitors 166 and 167, and diode 168 connected to the cancel bus 153. With automatic cancel circuit 156 not connected, the switches 68*a*–68*h* may be latched cumulatively so that more than one preset may be utilized at one time. If desired, LED circuits may be connected to output lines 154*a*–154*h* so as to indicate which of the preset switches 68*a*–68*h*** is latched.

The frame selector block 106 (FIG. 3A) comprises a MC14555 dual binary 1 of 4 decoder having its select inputs connected to lines 110, which are the Q7, Q8 and Q9 outputs of counter 168. The three bit binary word present on lines 110 changes each one hundred and twenty-eight bits of counter 168, and decoder 170 sequentially activates its outputs 172 in synchronism with the change of state of the binary word on lines 110. The outputs 172 of decoder 170 are connected to the inputs of NAND gates **174*a*–174*h*. Also applied to the inputs of NAND gates 174*a*–174*h* are the outputs 154*a*–154*h* of latches 150*a*–150*h*, respectively. The outputs of NAND gates 174*a*–174*h* are connected to the inputs of eight-input NAND gate 176, and its output is connected to one of the inputs of NAND gate 178. Another input to NAND gate 178 is the store pulse on line 180. The signal on line 182 connected to the output of NAND gate 176 is the frame activate signal, which activates for any group of one hundred and twenty-eight counts selected by preset switches 68*a*–68*h*. The output of NAND gate 178 on line 184** is the store command which instructs the system that it is in the store mode.

Figure 3A:
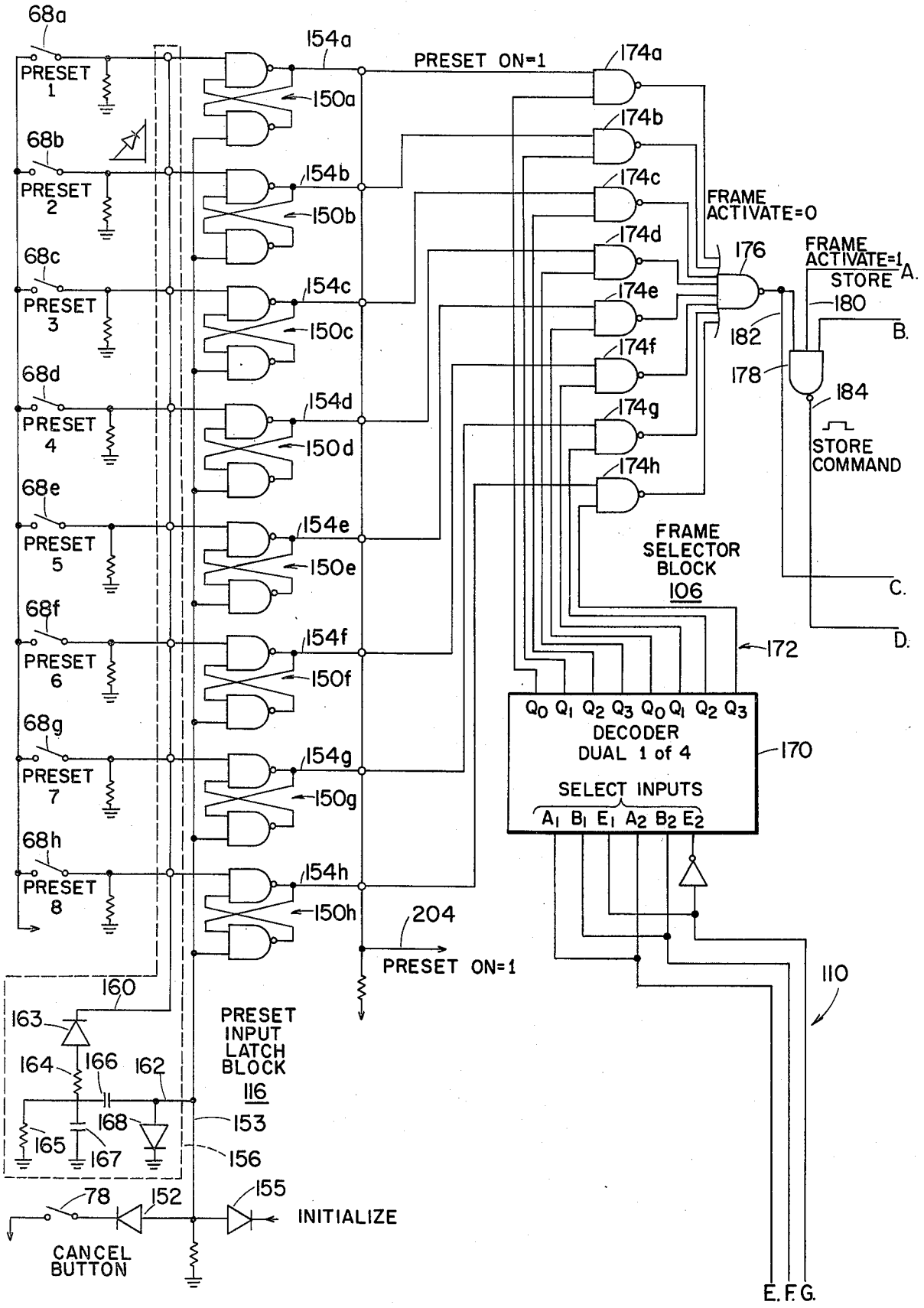
FIGS. 3A–3E together form a detailed schematic of the blind capture system.
Figure 3B:
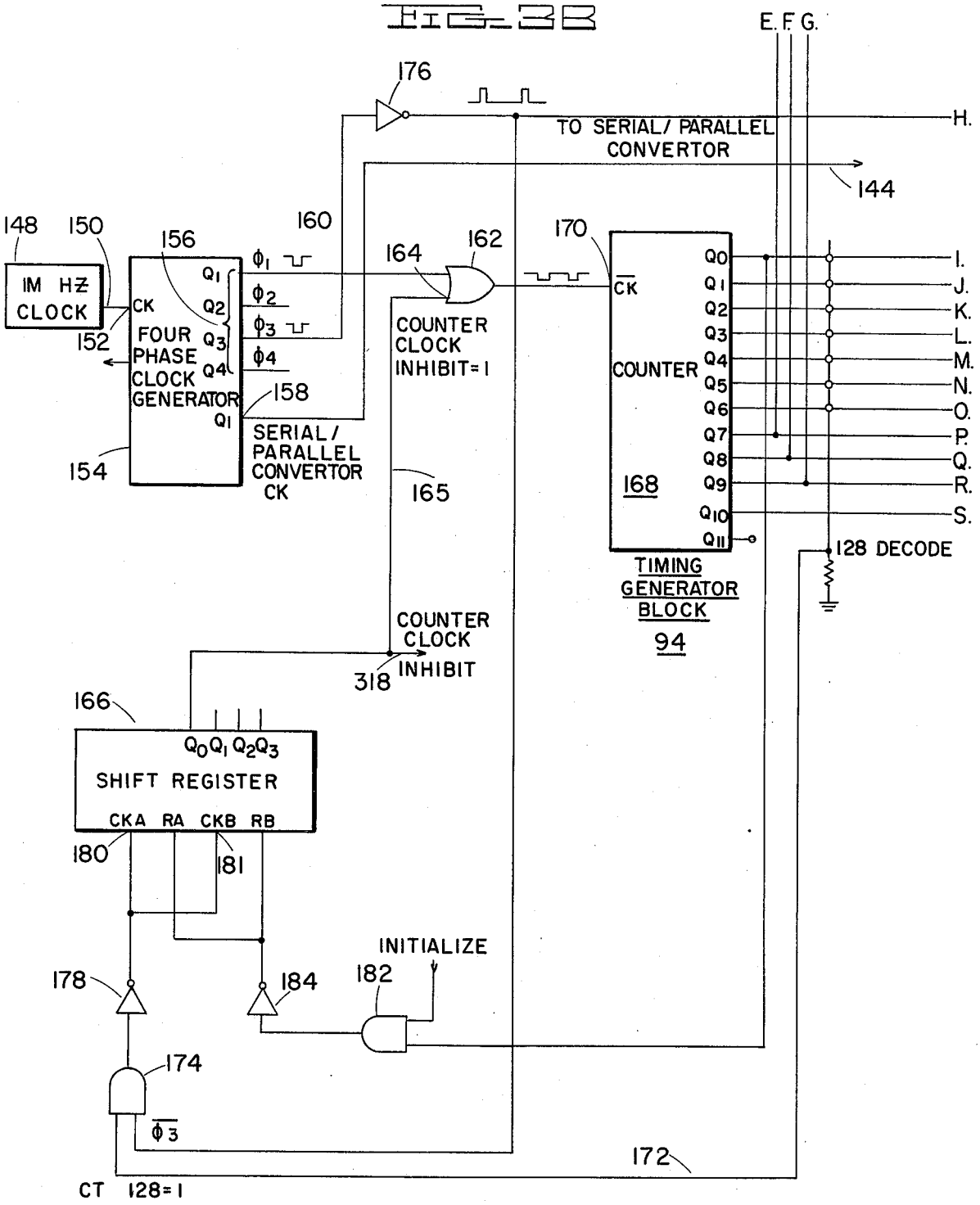
Figure 3C:
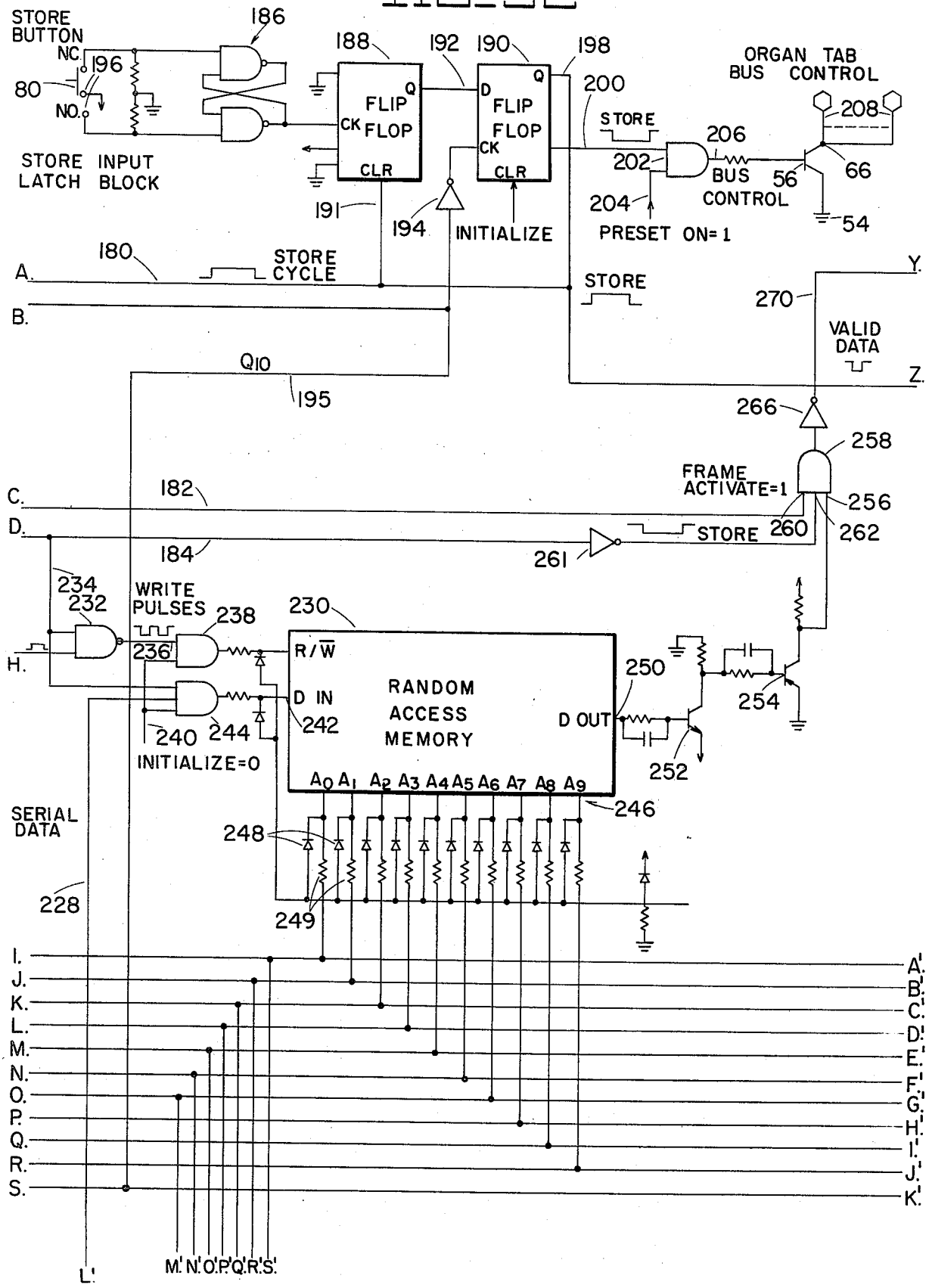

The store input latch block is illustrated in FIG. 3C and comprises latch 186 connected to the outputs of store switch 80, and a pair of 4013 dual D-type flip-flops 188 and 190. The output of latch 186 is connected to the clock input of flip-flop 188 and its clear input is connected over line 191 to line 180, which carries the store pulse. The Q output of flip-flop 188 is connected to the D input of flip-flop 190 by line 192, and the clock input is connected to line 195 through inverter 194. Line 195 is connected to the Q10 output of counter 168 (FIG.

3B), which cycles once every 2048 bits of counter 168. Latch 186 activates when store switch 180 is moved across contacts 196 so as to clock flip-flop 188 thereby activating the Q and $\overline{Q}$ outputs 198 and 200, respectively, on the occurrence of the next negative edge of counter bit Q10 on line 195. The Q output of flip-flop 190 clears flip-flop 188, and on the next occurrence of a negative edge of the Q10 pulse on line 195, flip-flop 190 is again clocked so as to terminate the store signals on lines 198 and 200. Thus, the store signal remains activated for 2048 bits, and it is during this time that the tab switches 38 which are selected are stored into the blind capture system.

The $\overline{Q}$ output 200 of flip-flop 190 is connected to one of the inputs of AND gate 202, and the other input carries the "preset on" signal from line 204 (FIG. 3A). The "preset on" signal activates when any preset latch 150*a*–150*h* has been activated so that the output of AND gate 202 on line 206 is the organ tab bus control signal. Transistor 56 is the electronic switch shown in block diagram form in FIGS. 1 and 2 and connects the one hundred and twenty-eight organ tab control lines 208 to ground potential 54 when it is switched on by the bus control signal on line 206.

Figure 3D:
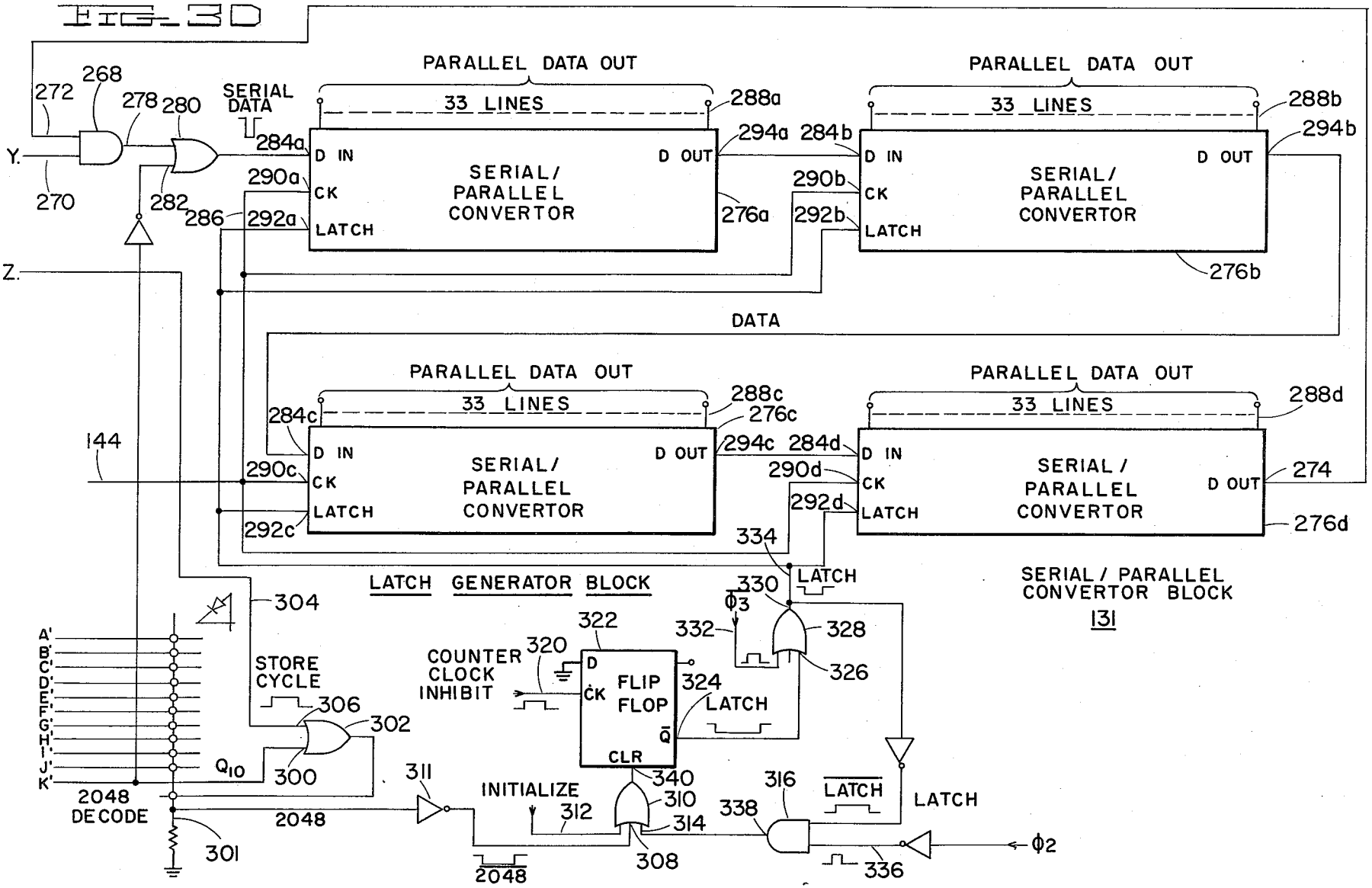
Figure 3E:
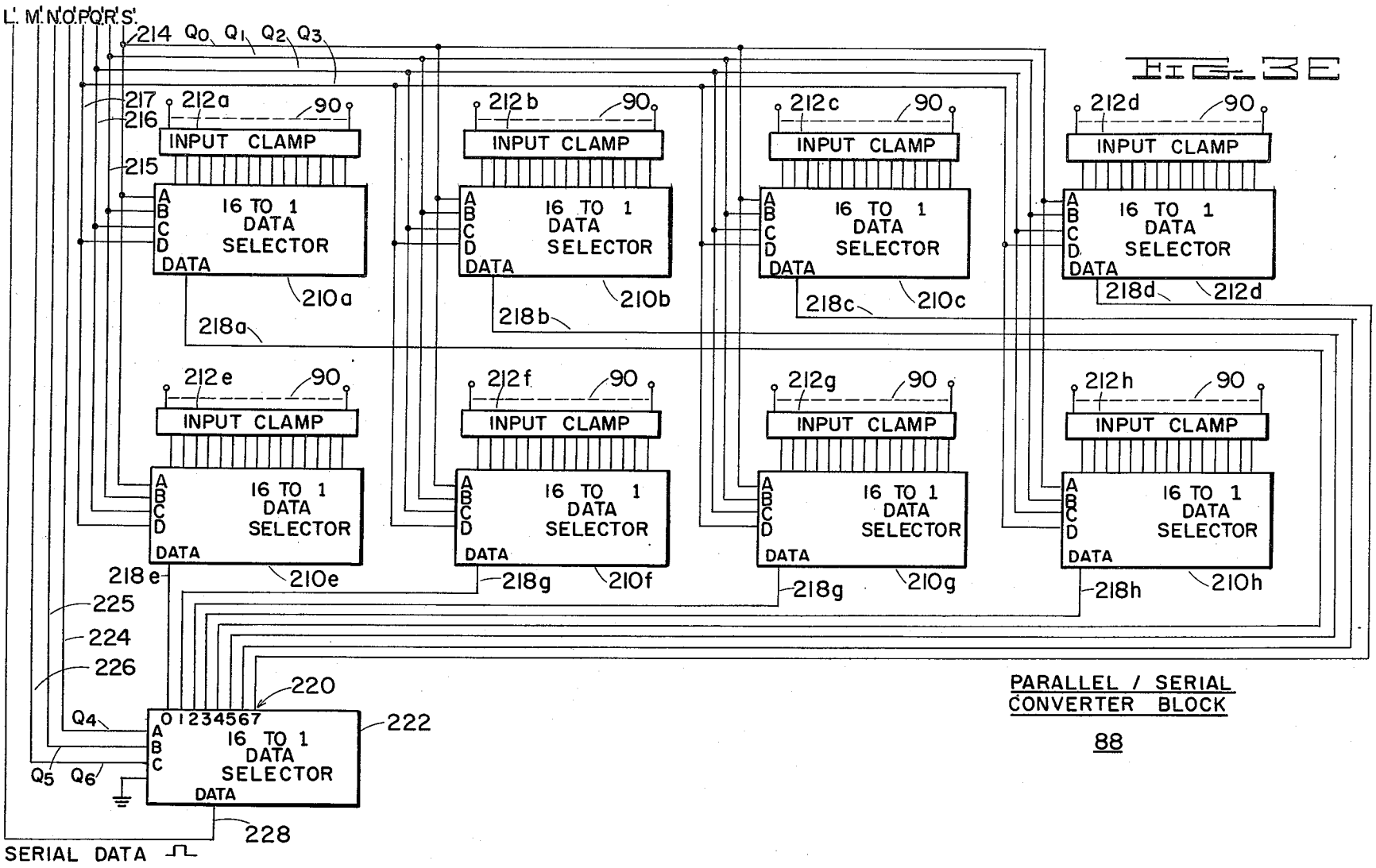

The parallel to serial convertor block 88 is shown in FIG. 3E and will be seen to comprise eight 74C150 16 to 1 data selectors 210*a*–210*h* having their data inputs connected to the organ tab lines 90 (FIG. 2) through input clamps 212*a*–212*h*, which are necessary to limit the input voltages applied to the data inputs to acceptable voltage levels. The addressing inputs ABCD for each of the data selectors 210*a*–210*h* are connected to lines 214, 215, 216 and 217, which are the Q0, Q1, Q2 and Q3 output of counter 168 (FIG. 3B), so that the sixteen inputs 90 for each of the data selectors 210*a*–210*h* will be selected sequentially, one at at time during the 16 different states of the address word at the address inputs ABCD. This produces on data output lines 218*a*–218*h* repeating 16 bit serial data streams corresponding to the respective closed tab switches 38 associated with the data selectors 210*a*–210*h*. These lines are connected to the eight data inputs 220 of 74C150 16 to 1 data selector 222, which is driven by the Q4, Q5 and Q6 clock pulses on lines 224, 225 and 226, respectively. Data selector 222 sequentially samples each of the data selectors 210*a*–210*h*, so that there appears on serial data output line 228 a serial data stream which is 128 bits in length corresponding to the tab switch combination selected by switches 38. It should be noted that the Q0-Q10 outputs of counter 168 (FIG. 3B) are in ascending order with the Q0 output being the least significant bit changing state at each clock pulse on input 170, and the Q10 output changing state once every 2048 clock pulses.

The memory block is shown in FIG. 3C, and comprises a MM2101 1,024 by 1 random access memory 230, wherein the 1,024 bit locations are divided into eight groups of one hundred and twenty-eight bits each. The eight groups are located at bits 1 to 128, bits 129 to 256, bits 257 to 384, bits 385 to 512, bits 513 to 640, bits 641 to 768, bits 769 to 896, and bits 897 to 1,024. These eight bit groups comprise the memory locations into which the tab preset data is stored.

NAND gate 232 has one of its inputs connected to line 234, which is connected to line 184, the output of NAND gate 178 (FIG. 3A). Line 234, therefore, carries the store command. The other input of NAND gate 232 is connected to the inverted phase 3 output of clock generator 154 so that, during the store cycle, the phase 3 clock pulses will appear on the output line 236 of NAND gate 232. The purpose of NAND gate 232 is to control the mode of operation in which the memory chip 230 is operating in, such that when tab information is being written into the memory 230, the output of gate 232 will be write pulses. When tab information is being read out of memory 230, the output of NAND gate 232 remains high so as to block the passage of the write pulses. Because NAND gates 174*a*–174*h* (FIG. 3A) are enabled sequentially, the write pulses will occur for one hundred and twenty-eight counts only within the frame or frames selected by the preset select switches 68*a*–68*h*.

The output of NAND gate 232 is applied to one of the inputs of AND gate 238 wherein it is gated together with the initialize pulse on line 240. The purpose of AND gate 238 is to properly initialize the memory 230 by ensuring, that when the system is first turned on, the output of AND gate 238 is forced into the write mode for approximately 50 milliseconds. During this time, the data input terminal 242 is disabled by AND gate 244 so that zero data is written into the memory locations within memory 230.

Serial tab data on line 228 from the parallel to serial convertor block 88 is connected to pin 242 of memory chip 230 through gate 244 wherein it is gated with the store command on line 234. Thus, input 242 remains disabled during initialization and at all times except for the proper store frame as determined by actuation of switches 68*a*–68*h* and the enabling of NAND gates 174*a*–174*h* (FIG. 3A).

Counter bits Q0 through Q9 from counter 168 (FIG. 3B) are applied to the address inputs 246 of memory 230 through a clamping network comprising diodes 248 and resistors 249. These inputs 246 cycle memory 230 sequentially through the eight groups of one hundred and twenty-eight counts so that each of the 1,024 memory locations can be written into or read out sequentially.

The data within memory 230 is read out on output 250 in serial form and passes through transistors 252 and 254, which are level shifting transistors, to input 256 of AND gate 258. Applied to input 260 of AND gate 258 is the frame activate signal on line 182, and applied to pin 262 is the inverted store pulse on line 184. Under normal operation, when a preset is selected, the output of AND gate 258 is the group or groups of the one hundred twenty-eight bits of tab information of the selected preset or presets. During a store cycle, however, data is inhibited from passing through AND gate 258 during the group of one hundred twenty-eight bits selected by the preset switches 68*a*–68*h* because of the inverted store command from inverter 261. The output of gate 258 is inverted by inverter 266 and transmitted to AND gate 268 (FIG. 3D) over line 270. The other input 272 of AND gate 268 is recirculated data from the output 274 of serial to parallel convertor 276*d*.

The output 278 of AND gate 268 is connected to one of the inputs of OR gate 280, and this output is a combination of input data from memory 230 and recirculated data from the output of serial to parallel convertor 276*d*. The other input 282 of OR gate 280 is inverted counter bit Q10, which occurs once every 2,048 counts of counter 168 and has a duration of 1,024 bits. OR gate 280 inhibits serial data from entering the MM5559 serial to parallel convertors 276*a*–276*d* during one half cycle of counter bit Q10 so that serial to parallel convertors 276a–276d are emptied during the half cycle of counter bit Q10 during which data is inhibited.

Data present at the input 284a of serial to parallel convertor 276a is shifted into and advanced one stage at each positive edge of the serial to parallel convertor clock on line 286 from line 144 (FIG. 3B).

Serial to parallel convertors 276a–276d comprise thirty-three output lines 288a, 288b, 288c and 288d, data input terminals 284a, 284b, 284c and 284d, clock inputs 290a, 290b, 290c and 290d, and latch inputs 292a, 292b, 292c and 292d. The serial data output terminal 294a of convertor 276a is connected to the data input terminal 284b of convertor 276b. Similarly, the serial data output terminal 294b of convertor 276b is connected to the data input terminal 284c of convertor 276c, and the serial data output terminal 294c of convertor 276c is connected to the data input terminal 284d of convertor 276d.

After one of the groups of one hundred and twenty-eight bits from meory 230 is loaded into the serial to parallel convertors 276a–276d, the address counter 168 (FIG. 3B) is inhibited for a duration of four input clocks by means of the counter clock inhibit signal at input 164 of OR gate 162. During the time that counter 168 is halted, the serial to parallel convertors 276a–276d advance the serial data contained therein through four bit locations because the serial to parallel convertors 276a–276d together comprise a total of one hundred and thirty-two serial bit locations. Therefore, data must be shifted down the serial data stream within the convertors 276a–276d an additional four bits in order that the data output pin 274 of converter 276d can be synchronized with the data from memory 230 at the data input 284a of convertor 276a. After serial data has been advanced the four bit locations in convertors 276a–276d, data at the data output pin 274 of convertor 276d is ready to be recirculated and loaded into the input of convertor 276a together with any new data from memory 230. Using this method of data recirculation, more than one of the groups of one hundred and twenty-eight bits from memory 230 can be read out and loaded into the serial to parallel convertors 276a–276d. In fact, all eight groups of one hundred and twenty-eight bits from memory 230 can be loaded with all of the eight preset tab combinations activated at once.

The output lines 288a–288d of serial to parallel convertors 276a–276d are connected via bidirectional data bus 52 and lines 298 to tab control lines 48 (FIGS. 1 and 2).

The latch generator block (FIG. 3D) generates the latch command which is utilized to transfer serial data to the parallel data outputs 288a–288d of convertors 276a–276d. The latch command is generated by detecting count 2,048 at the outputs of counter 168 by diode connecting the Q0-Q9 outputs to line 301 (FIG. 3D). Counter bit Q10 is applied to one of the inputs 300 of OR gate 302 and the store cycle signal on line 304 is connected to the other input 306. The function of OR gate 302 is to force the Q10 output high at the output of gate 302 during the first half of the store cycle during which time the Q10 output is normally low. By forcing the gated Q10 output of OR gate 302 high during the first half cycle of the store cycle, count 2,048 decode is generated at the end of the first half cycle of the store cycle during which time the serial to parallel convertors 276a–276d are loaded with zeros. The occurrence of forced count 2,048 at the end of the first half cycle of the store cycle causes zeros to be loaded into the parallel outputs of the serial to parallel convertor chips 276a–276d. This is necessary, since old data must be cleared out of the convertors 276a–276d in order that new tab data can be read into the memory 230.

Inverted count 2,048 is transmitted to input 308 of OR gate 310 through inverter 311. Line 312 carries the initialize signal and input 314 the output signal from AND gate 316. The counterclock inhibit signal from line 318 (FIG. 3B) is connected to line 320, which is the clock input for flip-flop 322, which is a 4013 D-type flip-flop. At the first positive edge of the counter clock inhibit signal, which occurs after count 2,048, the latch signal at the $\overline{Q}$ output 324 activates, and this is applied to the input 326 of OR gate 328. The output 330 of OR gate 328 doesn't activate, however, until the inverted phase 3 input pin 322 goes low, at which time the latch output 330 goes low and activates. It is at this time that the serial data of serial to parallel convertors 276a–276d is transferred to the parallel data outputs by virtue of the connection from the output 330 of OR gate 328 over line 334 to the latch inputs 292a–292d. The latch output remains activated until the inverted phase 2 pulse train on line 336 goes high, at which time the output 338 of AND gate 316 goes high which causes the clear input 340 of flip-flop 322 to activate thereby clearing flip-flop 322. This deactivates the latch command. The initialize signal is applied to line 312 which is connected to one of the inputs of OR gate 310 in order that flip-flop 322 be initialized to the inactive state when the system is first turned on.

At the end of the memory read cycle, when selected data has been read from memory 230 and loaded into convertors 276a–276d, the latch command at latch inputs 292a–292d, causes the data which is located in the proper serial bit locations within the convertors 276a–276d to be loaded into the parallel output latches and appear on outputs 288a–288d. This data is then available for use by the organ in selecting the corresponding voicing within audio switching section 22 (FIG. 1).

Memory 230 is of the type which requires that power be constantly applied thereto in order to retain the data which has been stored. Accordingly, the system may be provided with a battery for this purpose. Alternatively, the power supply may be constantly activated as long as the organ is connected to a source of power. If desired, a circuit could be provided to cause a light to flash or render some other type of indication or alarm in the event the organ is unplugged. This would be desirable in the case where an organ is set up with a number of presets by the organist in advance of a performance. Circuits of this type have been used extensively in connection with computers employing dynamic memories, and circuits for indicating when a power failure has occurred, for example in the case of freezers wherein it is desirable to know that a power failure has occurred and that food spoilage may have resulted.

Circuitry for generating initialize signals, which are always necessary in electronic circuits of this general nature, are similarly well known in the art.

Figure 7:
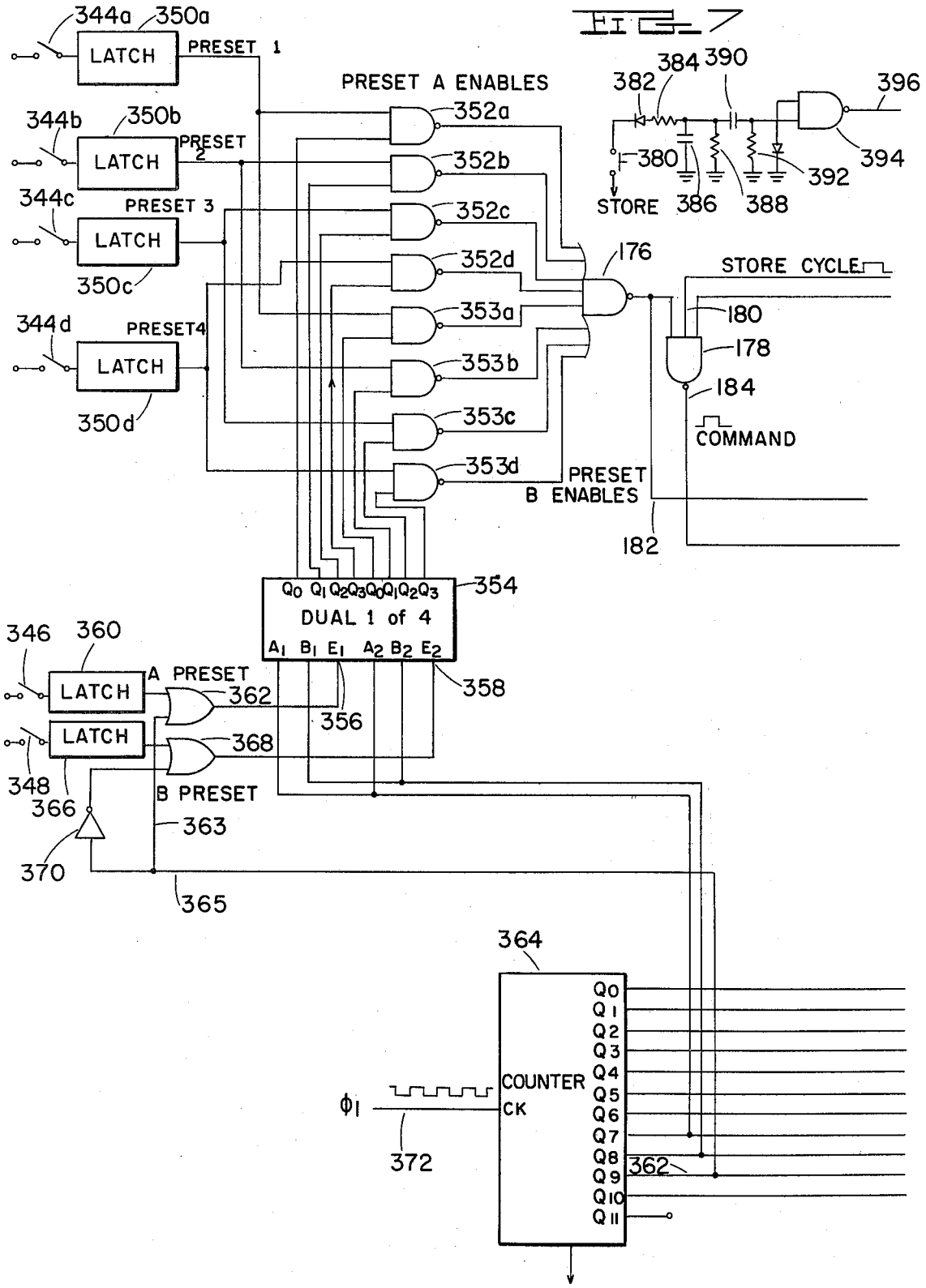
FIG. 7 is a detailed schematic of a modification to the preset selection and store activation circuitry.

FIG. 7 illustrates a modification to the store and preset selection circuitry previously described. With regard to the preset selection, the circuitry shown in FIG. 7 requires only four preset switches 344a, 344b, 344c and 344d together with A and B group selection switches 346 and 348. By combining one or more of the preset switches 344a–344d with either or both of the A or B group selection switches 346 and 348, up to eight presets may be selected, either individually or in combination with one or more of the others.

Switch 344*a* is connected to latch 350*a*, the output of which is connected to one of the inputs of NAND gates 352*a* and 353*a*. The other inputs for NAND gates 352*a* and 353*a* are connected to the $Q_0$ outputs of MC14555 dual binary 1 of 4 decoder 354 so that NAND gate 352*a* will be enabled at time $Q_0$ when an enabling voltage is present on the enable input 356 of decoder 354, and NAND gate 353*a* will be enabled at time Q0 when the enabling input 358 for the second half of decoder 354 has an enable voltage present thereon. Similarly, preset selection switch 344*b* is connected through latch 350*b* to one of the inputs of NAND gates 352*b* and 353*b*. NAND gates 352*b* and 353*b* are enabled at times Q1 when the first half and second half of decoder 354 are enabled by the presence of enabling voltages at their enable inputs 356 and 358, respectively. In a similar fashion, switches 344*c* and 344*d* are connected through latches 350*c* and 350*d* to the respective inputs of NAND gates 352*c*, 353*c*, 352*d* and 353*d*. These NAND gates are connected to the Q2 and Q3 outputs of the first and second halves of decoder 354 and are enabled in a similar fashion.

A group selector switch 346 is connected through latch 360 to one of the inputs or OR gate 362, the other input of which is the Q9 output of 4040 counter 364 over lines 363 and 365. The B group select switch 348 is connected through latch 366 to one of the inputs of OR gate 368, the other input of which is connected to line 365 through inverter 370. Counter 364 is clocked by the phase 1 pulse train from clock generator 154 over line 372.

The outputs of NAND gates 350*a*-353*d* are connected to the inputs of NAND gate 176, which is connected in the same manner as in FIG. 3A.

With switch 346 closed, OR gate 362 will enable the first half of decoder 354 so that its Q0-Q3 outputs will be successively activated as the two bit Q7, Q8 binary word developed by counter 364 changes states. OR gate 368 will be disabled while the Q9 output of counter 364 is in the first binary state due to the inverter 370 output which is inverted Q9. Depending on which of switches 344*a*-344*d* are closed, NAND gates 352*a*, 2*b*, 352*c* and 352*d* will be enabled in succession by the Q0, Q1, Q2, and Q3 outputs of decoder 354 so as to generate the frame activate signal at the output of NAND gate 176. If all four of switches 344*a*-344*d* are closed, each of the NAND gates 352*a*-352*d* will be enabled in succession and the combination of the four presets of group A will be activated.

If only the group B select switch 348 is closed, OR gate 362 will be disabled and OR gate 368 enabled so that the second half of decoder 354 will be enabled during the alternate state of the Q9 output of counter 364. Thus, depending on which of switches 344*a*-344*d* are closed, NAND gates 353*a*, 353*b*, 353*c* and 353*d* will be enabled in succession by the Q0, Q1, Q2 and Q3 outputs of decoder 354 during the next four time frames. If, for example, all of switches 344*a*-344*d*, 346 and 348 are closed, NAND gates 352*a*-353*d* will be enabled in succession and all eight selected presets will be activated in combination.

This format for preset selection is more compatible with home organs, which typically do not have a large number of control switches and tabs as is the case with large institutional organs. Thus, the four preset select switches 344*a*-344*b* are capable of dual function in that they can select, either singly or in combination, two preset groups, those groups being group A and group B.

FIG. 7 also illustrates an alternative circuit for the store switch 380, which in this case is a single pole, single throw switch. The store input is applied through diode 382 and 1K resistor 384, so that as soon as switch 380 is closed, 220 pf capacitor 386 charges to the voltage on switch 380. This voltage then appears across 100K resistor 388 and is differentiated by 0.01 mf capacitor 390 and 47K resistor 392 to the input of NAND gate 394. Gate 394 inverts the negative going pulse so that a positive going pulse appears on line 396, which is applied to the clock input of flip-flop 188 (FIG. 3C).

It will be recalled that the latch generator block shown in FIG. 3D caused a latch command to be transmitted to the serial to parallel convertors 276*a*-276*d* on every occurrence of count 2,048. This was accomplished by decoding the Q0-Q9 outputs of counter 168 together with the gated Q10 output from OR gate 302 such that, when logic 1's occurred at each of these points, a pulse was generated at the output of inverter 311 which would cause a latch pulse to appear at the output 330 of OR gate 328. When a store pulse is present on line 304, however, these same conditions will occur at the half cycle point of Q10 and an extra latching pulse will be generated so as to clear the parallel outputs of the serial to parallel convertors 276*a*-276*d* so that only new data will be written into the memory 230 during the store cycle. The data is cleared from the parallel outputs of convertors 276*a*-276*d* by forcing logic zeros into the parallel output latches.

Figure 8:
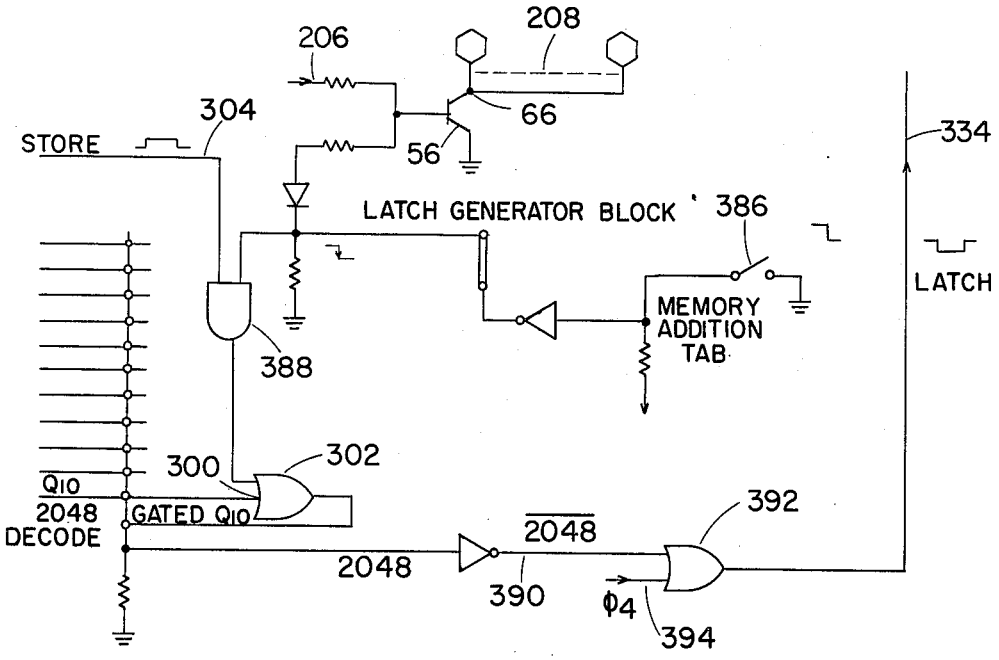
FIG. 8 is detailed circuit schematic of a modification to the latch generation circuitry resulting in a memory addition feature.

FIG. 8 illustrates an alternative circuit to be substituted in FIG. 3C whereby tabs can be added to a previously stored preset arrangement without the necessity for resetting all of the previous tabs. This is accomplished by closing the memory addition tab switch 386, which disables AND gate 388 from passing the positive going store pulse on line 304. Thus, the gated Q10 signal from the output of OR gate 302 will correspond exactly to the Q10 output generated by counter 168 (FIG. 3B). This will cause the previously stored data for the selected time frame to remain on the outputs 288*a*-288*d* of convertors 276*a*-276*d* so that it will again be written into the memory together with the newly selected tabs thereby resulting in a stored tab arrangement which is a combination of the two. With switch 386 on, additional tab switches can be selected even during blind capture operation.

The inverted count 2,048 decode signal on line 390 is gated by OR gate 392 together with the phase 4 clock pulse from clock generator 154 on line 394. The latch pulse appears on line 334 as was the case with the previous embodiment shown in FIG. 3D.

Figure 4:
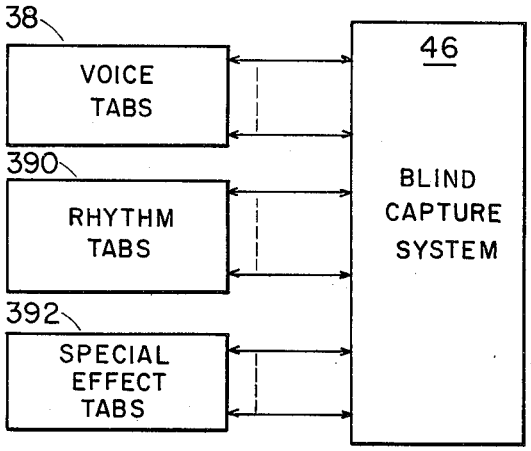
FIG. 4 is a block diagram illustrating an application of the blind capture system to the voice tabs of an organ.

An alternative application of the blind capture system is shown in FIG. 4 wherein the rhythm tabs 390 and special effect tabs 392 are capable of being preprogrammed by the blind capture system 46 as well as the voice tabs 38 as previously described. By enabling all of the non-keyboard controls of the organ to be preprogrammed by the organist prior to a concert, the organist is free to concentrate on playing the keyboard rather than actuating the various control switches of the organ.

Figure 5:
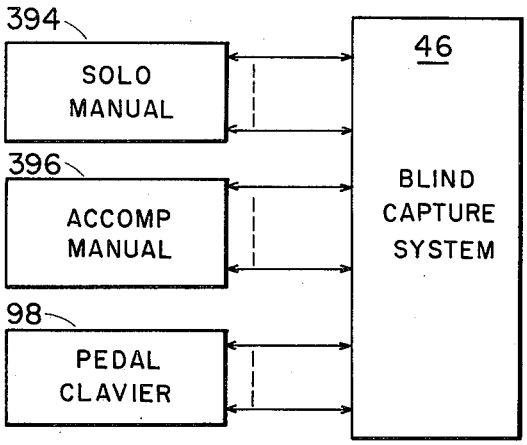
FIG. 5 is a block diagram which illustrates the application of the blind capture system to the keyboards of an organ.

FIG. 5 illustrates an application of the blind capture system 46 wherein the keys of the solo manual 394, the keys of the accompaniment manual 396 and the pedal clavier 98 can be preprogrammed so that the organist has the capability of playing complex chord patterns or pedal accompaniments simply by actuating the preset switches 68.

Figure 6A:
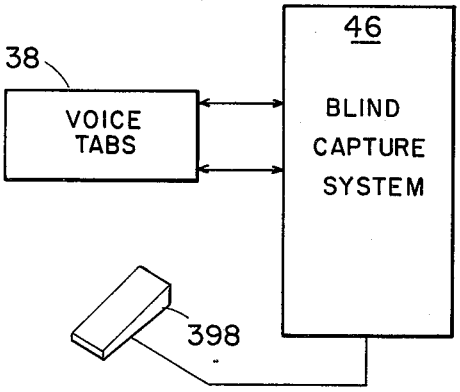
FIG. 6A is a block diagram of a modification to the blind capture system wherein an organ voicing crescendo effect can be obtained.
Figure 6B:
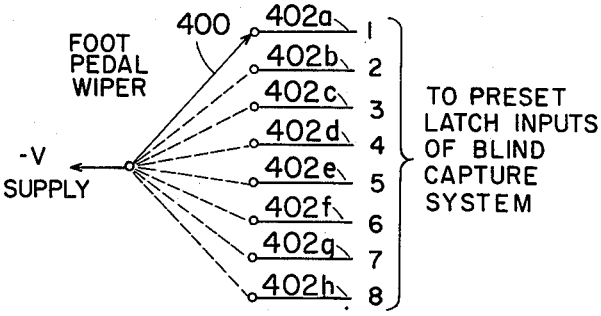
FIGS. 6B and 6C are schematics showing two alternative embodiments of the crescendo effect system of FIG. 6A.
Figure 6C:
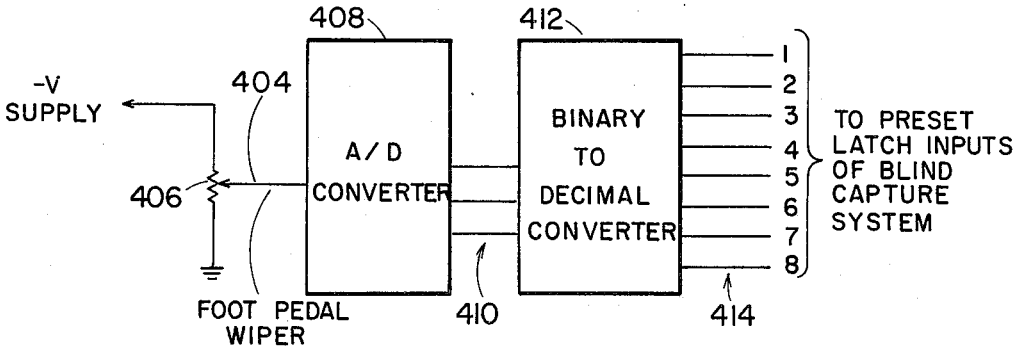

FIGS. 6A–6C illustrate an application of the blind capture system 46 to an organ crescendo system wherein predetermined organ voice tab combinations are selected in response to the progressive depression of the expression pedal 398. As the expression pedal 398 is moved from one position to another, the number of organ voices cumulatively increases thereby achieving very easily the crescendo effect which would otherwise have to be achieved manually by cumulatively switching preset pistons.

FIG. 6B illustrates one embodiment of the foot pedal 398 which is seen to comprise a single pole eight throw switch wherein wiper 400 sequentially connects with contacts **402*a*–402*h*. Contacts 402*a*–402*h* are connected to the inputs of latches 150*a*–150*h*** (FIG. 3A) and the system is configured such that the actuation of a subsequent preset does not automatically cancel out the previous preset.

FIG. 6C illustrates an alternative arrangement whereby footpedal wiper 404 engages a resistive element 406 so as to function as a potentiometer. Analog to digital convertor 408 converts the voltage level on wiper 404 to a four bit binary word on output lines 410. Binary to decimal convertor 412 converts the binary word to eight decimal outputs 414, which are connected to the inputs of latches **150*a*-150*h***.

Another application of the system would be to program various combinations of lights, such as LED's, which represent different numbers, letters or patterns. A large number of these light switch combinations could be stored into the system to be recalled at a later time, thereby permitting the preprogramming of the light display show. Other applications of the system are also possible, and the present invention is intended to cover such applications.

Figure 9:
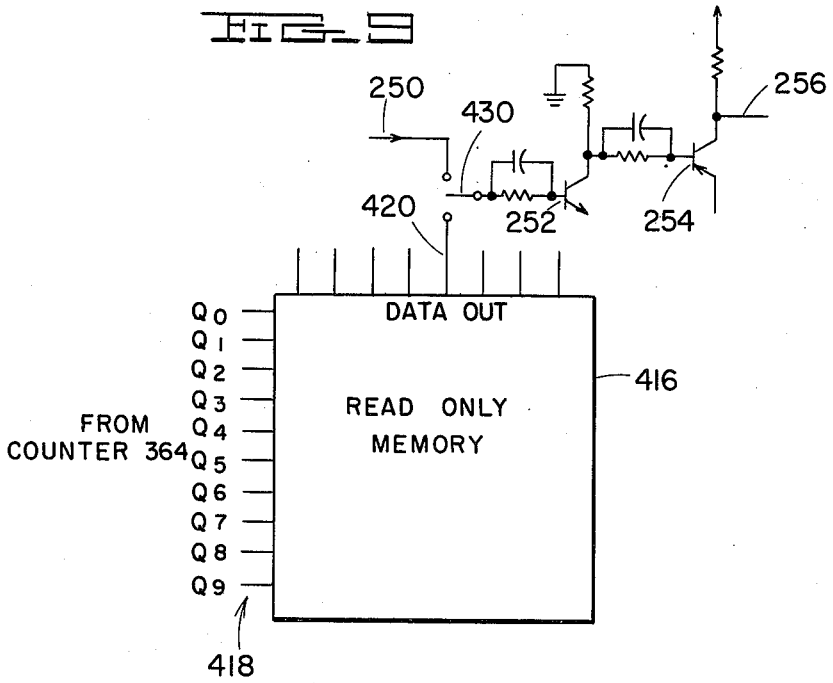
FIG. 9 is a schematic of a modification to the system wherein a read only memory is included.

FIG. 9 illustrates the manner in which a read only memory 416 could be included in the blind capture system so as to enable the implementation of factory programmed preset combinations. Read only memory 416, which may be a 6830 1K by 8 ROM, is programmed such that it contains eight different preset combinations, each combination having the capability of one hundred and twenty-eight tab switches. Memory 416 is sequentially addressed by the Q0-Q9 inputs, which are connected to the respective outputs of counter 168. This will produce on output line 420 a serial data stream having 1024 time slots with pulses appearing in those time slots corresponding to desired ones of tab switches 68.

The selected data stream from read only memory 416 is compatible with the data stream read out of memory 230. Two pole switch 430 is manually actuable by the player either to select the data stream from the random access memory 230, line 250, or the data stream from read only memory 416, line 420. The selected data stream is applied to level shifting transistor 252, and proceeds through the circuitry as described before.

It will be appreciated that the data stream at the read only memory output 420 is completely compatible with the data stream read out of memory 230 due to the fact that read only memory 416 is addressed by the same counter outputs (Q0-Q9) from counter 168 as is random access memory 230. Thus, the present invention has the advantages of both hard wired preset tab systems, in which the memory is preprogrammed and unchangeable, and the user presettable systems in which the memory can be programmed by the organist.

The read only memory chip 416 could also be one of the varities of electrically alterable programmable read only memory chips. By utilizing such a chip, the organist could easily reprogram the tab selections into the memory wherever and whenever he desires, and the alterable read only memories would then permanently retain these tab combinations even when the organ is not turned on.

While this invention has been described as having a preferred design, it will be understood that it is capable of further modification. This application is, therefore, intended to cover any variations, uses, or adaptations of the invention following the general principles thereof and including such departures from the present disclosure as come within known or customary practice in the art to which this invention pertains and fall within the limits of the appended claims.

What is claimed is:

1. In a keyboard musical instrument for producing tones including means for controlling the tones produced by the instrument under the control of a plurality of player operated switches, said switches having respective outputs electrically connected to said means for controlling the tones, the improvement being a blind capture system comprising:

a programmable memory capable of storing data representative of the composite states of said switches, said memory having alternative write and read modes, a bidirectional data bus means having lines connected respectively to said outputs carrying electrical signals corresponding to electrical states of respective said switches, memory input means interposed between said data bus means and said memory for writing into a section of said memory, when the memory is in the write mode, preset data representative of the states of said switches, said preset data corresponding to the electrical signals present on said data bus means, memory output means interposed between said memory and said data bus means for reading out of said memory, when the memory is in the read mode, said preset data and placing on said data bus means electrical signals corresponding to the preset data read out, the electrical signals on said data bus means when said memory is in the write mode corresponding to actual states of said switches, and means for isolating said switches from their said outputs when the memory is in the read mode.

2. The system of claim 1 wherein said memory input means includes multiplexer means for scanning the lines of said data bus means and producing a time division multiplexed serial data stream which is inputted into said memory, said serial data stream comprising a plurality of time slots corresponding to respective lines of the data bus with switch-closed signals in time slots corresponding to those lines of the data bus connected to closed ones of said switches when the memory is in the write mode.

3. The system of claim 2 wherein the data read out of said memory is in the form of a time division multiplexed serial data stream, and said memory output means includes demultiplex means for demultiplexing the serial data stream read out of said memory to place corresponding parallel electrical signals on said data bus means.

4. The system of claim 1 wherein said means for controlling the tones produced by the instrument comprises electronic switches having respective tones connected to their inputs and having their outputs connected to output circuitry of the musical instrument, said electronic switches having control terminals connected to the respective lines of said data bus means and also to the respective outputs of the player operated switches.

5. The system of claim 4 wherein said instrument is an organ and said player operated switches are tab switches.

6. The system of claim 4 wherein said means for isolating said switches comprises a common bus electrically connected to a side of each of said player operated switches opposite their respective outputs and enabling switch means interposed between said common bus and an electrical potential, said enabling switch means isolating said player operated switches when it one of connects or disconnects said common bus from said potential and enabling said player operated switches when it the other of connects or disconnects said common bus from said potential.

7. The system of claim 6 wherein said potential is ground potential and said enabling switch means enables said player operated switches when it connects said common bus to ground potential.

8. The system of claim 1 wherein said memory comprises a plurality of storage frames in which data corresponding to a plurality of separate combinations of states of said player operated switches can be stored, respectively, and including player operated preset select means for controlling said memory input and output means to store preset data corresponding to a particular combination of states of said player operated switches in a selected frame of said memory when said memory is in the write mode, and for reading out data from a selected frame when said memory is in the read mode.

9. The system of claim 8 wherein said preset select means comprises a plurality of preset select switches.

10. The system of claim 8 wherein said preset select means comprises a plurality of momentary switches and latches connected respectively thereto.

11. The system of claim 8 wherein said memory input means includes multiplexer means for scanning the lines of said data bus means and producing a time division multiplexed serial data stream which is inputted into said memory, the data read out of said memory is in the form of a time division multiplexed serial data stream, and said memory output means includes demultiplex means for demultiplexing the serial data stream read out of said memory to place on said data bus means corresponding parallel electrical signals, said serial data stream read out of said memory including a plurality of consecutive data frames corresponding to respective said separate combinations of states of said player operated switches.

12. The system of claim 11 wherein said demultiplex means is controlled by said preset select means and demultiplexes a data frame of the serial data stream read out of said memory which is selected by said preset select means.

13. The system of claim 8 wherein said memory input means comprises multiplexer means for scanning the lines of said data bus means and producing a time division multiplexed serial data stream corresponding to the combination of electrical signals on the lines of said data bus means, said serial data stream being inputted into said memory, said memory input and output means including address means synchronized with said multiplexer means and demultiplex means for sequentially addressing the storage frames of said memory, and selectively activated store means for placing said memory in the write mode and operatively connecting said player operated switches to their respective outputs for a complete scan of said data bus means by said multiplexer means only during the time interval that a storage frame selected by said preset select means is being addressed by said memory address means to thereby store the data corresponding to the composite states of said player operated switches in the selected storage frame.

14. The system of claim 13 including means synchronized with said address means for storing data in said memory corresponding to additional said player operated switches in the selected storage frame without erasing data presently in the selected storage frame.

15. The system of claim 8 wherein said preset select means comprises at least two groups of player operable preset select switches wherein the combined total of said preset select switches is less than the number of said storage frames, and means responsive to the actuation of any switch from one group together with the actuation of any switch from the other group to select the frame of said memory in which data is stored and read out.

16. The system of claim 1 wherein said instrument is an organ and said player operated switches are voicing tab switches.

17. The system of claim 1 wherein said instrument is an organ and said player operator switches comprise playing keys of a keyboard of the organ.

18. The system of claim 1 including read only memory means for storing data corresponding to a plurality of separate combinations of states of said switches in respective sections of said read only memory means, and means for reading out of said read only memory means data in a selected section thereof and placing on said data bus means electrical signals corresponding to the data read out of the selected section.

19. The system of claim 18 including selector means for enabling data alternatively from said programmable memory means and said read only memory means to be read out and corresponding electrical signals placed on said data bus means.

20. The system of claim 19 wherein the serial data stream read out of said memory comprises a plurality of consecutive data frames corresponding to respective said storage frames of said memory, and wherein said demultiplex means demultiplexes only that data frame corresponding to the selected storage frame of the memory.

21. In a keyboard musical instrument for producing tones including means for controlling the tones produced by the instrument under the control of a plurality of player operated switches, said means for controlling the tones having respective inputs electrically connected to outputs of said switches, the improvement being a blind capture system comprising:

a programmable memory capable of storing data representative of the composite states of said switches, said memory comprising a plurality of storage frames in which data corresponding to a plurality of separate combinations of actuated said player operated switches can be stored, respectively, memory input means interposed between said switches and said memory for scanning said switches and inputting data into said memory in the form of a time division multiplexed serial data stream corresponding to the actuated switches, memory output means interposed between said memory and the inputs of said means for controlling the tones for reading out data stored in said memory in a time division multiplexed serial data format, demultiplexing said data read out and placing on said inputs of said means for controlling the tones electrical signals corresponding to said data read out, address means synchronized with the time division multiplexed data for sequentially addressing the storage frames of said memory, player operated preset select means for controlling said memory input and output means to store and read out data from a selected frame of said memory, selectively actuated store means operatively connected with said memory input means for operatively connecting said player operated switches to said memory input means to enable said switches to be scanned and data inputted to said memory only during the time interval that a storage frame selected by said preset select means is being addressed by said memory address means to thereby store data corresponding to the actuated player operated switches in the selected storage frame, and selectively actuated memory addition means synchronized with said address means for storing data in a selected frame of said memory corresponding are actuated without erasing data presently in the selected frame.

22. In a keyboard musical instrument for producing tones including means for controlling the tones produced by the instrument under the control of a plurality of player operated switches, said means for controlling the tones having respective inputs electrically connected to outputs of said switches, the improvement being a blind capture system comprising:

a programmable memory capable of storing data representative of the composite states of said switches, said memory comprising a plurality of storage frames in which data corresponding to a plurality of separate combinations of actuated said player operated switches can be stored, respectively, memory input means interposed between said switches and said memory for scanning said switches and inputting data into said memory in the form of a time division multiplexed serial data stream corresponding to the actuated switches, memory output means interposed between said memory and the inputs of said means for controlling the tones for reading out data stored in said memory in a time division multiplexed serial data format, demultiplexing said data read out and placing on said inputs of said means for controlling the tones electrical signals corresponding to said data read out, address means synchronized with the time division multiplexed data stream for sequentially addressing the storage frames of said memory, a read only memory in which is stored data corresponding to a plurality of separate combinations of actuated said player operated switches, means for addressing said read only memory to read data out of said read only memory and place on said inputs of said means for controlling the tones related electrical signals corresponding to a selected combination of actuated said player operated switches, and player operated selector switch means for selectively disabling data from said programmable memory and for selectively disabling data from said read only memory.

23. The system of claim 22 wherein said selector switch means comprises means for alternatively disabling data from said programmable memory and said read only memory.

* * * * *

UNITED STATES PATENT AND TRADEMARK OFFICE

CERTIFICATE OF CORRECTION

PATENT NO. : 4,300,436

DATED : November 17, 1981

INVENTOR(S) : Gary R. Fritz and John W. Robinson

It is certified that error appears in the above—identified patent and that said Letters Patent is hereby corrected as shown below:

Column 1, line 55, change "of" to --or--
Column 2, line 32, change "be" to --by--
Column 5, line 55, change "voilins" to --violins--
Column 5, line 64, change "sinal" to --signal--
Column 7, line 37, change "unitl" to --until--
Column 7, line 37, change "eitht" to --eight--
Column 11, line 56, change "MM2101" to --MM2102--

Column 13, line 20, change "meory" to --memory--
Column 14, line 16, change "322" to --332--
Column 15, line 26, change "or" to --of--

Claim 21, column 21, line 38, after "corresponding" insert --to additional said player operated switches which--

Signed and Sealed this

*Eleventh* Day of *May 1982*

[SEAL]

*Attest:*

GERALD J. MOSSINGHOFF

*Attesting Officer*

*Commissioner of Patents and Trademarks*